US007591768B1

(12) United States Patent
Geeting

(10) Patent No.: US 7,591,768 B1
(45) Date of Patent: Sep. 22, 2009

(54) STRIKING TARGET DEVICE

(76) Inventor: Eliot Geeting, 76 Terra Vista, Dana Point, CA (US) 92629

( * ) Notice: Subject to any disclaimer, the term of this patent is extended or adjusted under 35 U.S.C. 154(b) by 0 days.

(21) Appl. No.: 12/101,819

(22) Filed: Apr. 11, 2008

Related U.S. Application Data

(63) Continuation of application No. 10/801,239, filed on Mar. 6, 2004, now abandoned.

(60) Provisional application No. 60/455,352, filed on Mar. 17, 2003, provisional application No. 60/531,912, filed on Dec. 23, 2003.

(51) Int. Cl.
*A63B 69/20* (2006.01)
*A63B 69/34* (2006.01)

(52) U.S. Cl. ..... 482/86; 482/83

(58) Field of Classification Search ..... 482/83–90
See application file for complete search history.

(56) References Cited

U.S. PATENT DOCUMENTS 4,491,316 A 1/1985 Prince
4,662,630 A 5/1987 Dignard et al.
4,688,792 A 8/1987 Rivkin
4,913,419 A 4/1990 McAuliffe
5,254,062 A 10/1993 Hoffman
5,458,552 A 10/1995 Mara
5,464,377 A 11/1995 Beeman
5,554,088 A 9/1996 Zlojutro
6,033,348 A 3/2000 Warshauer

*Primary Examiner*—Fenn C Mathew
(74) *Attorney, Agent, or Firm*—Eric Karich

(57) ABSTRACT

A striking target device has a target body with a generally planar striking surface with a main striking area and at least one pivot striking area. The device further includes a base, and a pivot mechanism for pivotally mounting the target body on the base such that the striking area remains fixed on a first plane when struck in the main striking area, but pivots on an axis to a different fixed plane when struck in the pivot striking area. The pivot mechanism includes a cam edge of the base, a cam follower of a guide tube of the target body, and a tension element for biasing the cam edge against the cam follower. The pivot mechanism allows the target body to pivot about the axis such that striking surface pivots to a different fixed striking plane when struck in the pivot striking area.

4 Claims, 9 Drawing Sheets

STRIKING TARGET DEVICE

CROSS-REFERENCE TO RELATED APPLICATIONS

This application for a utility patent is a continuation of previously filed utility patent, having the application Ser. No. 10/801,239, filed Mar. 6, 2004 now abandoned.

This application also claims the benefit of U.S. Provisional Application No. 60/455,352 filed on Mar. 17, 2003, and U.S. Provisional Application No. 60/531,912 filed on Dec. 23, 2003. Each of these related applications is incorporated herein by reference in its entirety.

BACKGROUND OF THE INVENTION

1. Field of the Invention

This invention relates generally to exercise, martial arts, and/or boxing devices, and more particularly to a device that enables the user to practice strikes at different planes and from different directions in rapid succession.

2. Description of Related Art

Many devices have been invented to assist with strike training. Some assist the user in performing strikes by contacting a heavy, sturdy object (heavy bag) that does not allow the strikes to pass through. Others assist the user in performing strikes by contacting a target that is flexible allowing the strike to pass through to reduce impact and allow for full range of motion and full follow through of the strike. These devices are generally shaped like a ball allowing them to be struck from several directions or flat allowing them to be struck on either flat side on the same plane. The "ball like" devices are generally attached on one end or suspended between two opposing flexible attachments which allows them to move freely creating a live target that must be controlled; this is an effective way to develop timing and coordination, and to some degree accuracy of striking.

In contrast the flat targets are restricted in their movement. Most allow for flexing in some manner (spring or some flexible material) to absorb the impact and allow the strike to pass through, however they do not allow for strikes from different planes, and although they offer accuracy training they offer little in the area of timing, speed and coordination training.

In some cases the flat striking targets can be struck from different planes. For example, U.S. U.S. Pat. No. 4,913,419 to McAuliffe, and U.S. Pat. No. 4,662,630 to Dignard & Roberts, teach such devices; however the user must stop training and unhook or unfasten a locking/fastening means and change the striking plane, then refasten, and start striking again in the new plane, such as vertical verses horizontal.

Traditional hand held focus targets can be struck from different planes as a result of the person holding the target holding it at a different angle, however the person holding the target has to move faster than the person executing the strikes or it will be of little benefit for speed training, and the person performing strikes cannot train alone.

U.S. Pat. No. 5,458,552 to Mara provides a device for holding a target similar to a traditional hand held focus target, however it has the same limitation of unfasten a locking/fastening means to change the striking plane.

The above-described references are hereby incorporated by reference in full.

The prior art teaches fixed plane generally flat targets used for accuracy strike training and ball/cylindrical style targets that can be struck on more than one plane or angle for coordination, timing and speed training. However, the prior art does not offer any strike training targets combining all these benefits by utilizing a pivoting or turning feature and more than one specific strike point on the striking surface to allow the striking surface to make specific and distinctive plane/angle changes when struck. The present invention fulfills these needs and provides further related advantages as described in the following summary.

SUMMARY OF THE INVENTION

The present invention teaches certain benefits in construction and use which give rise to the objectives described below.

The present invention provides a striking target device and method for strike training. The striking target device comprises a target body with a generally planar striking surface with a main striking area and at least one pivot striking area; a base; and a pivot mechanism for pivotally mounting the target body on the base such that the striking area remains fixed on a first plane when struck in the main striking area, but pivots on an axis to a different fixed plane when struck in the pivot striking area. The pivot mechanism includes a cam edge of the base, a cam follower of a guide tube of the target body, and a tension element for biasing the cam edge against the cam follower. The pivot mechanism allows the target body to pivot about the axis such that striking surface pivots to a different fixed striking plane when struck in the pivot striking area.

A primary objective of the present invention is to provide a striking target device having advantages not taught by the prior art.

Another objective is to provide a striking target device that enables the user to perform strikes on a target that has first and second specific striking areas, and by striking the first striking area the striking target device will flex and then return to the same striking plane, and by striking the second striking area the striking target device will pivot to a new striking plane.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DESCRIPTION OF THE PREFERRED EMBODIMENT OF THE INVENTION

Figure 1:
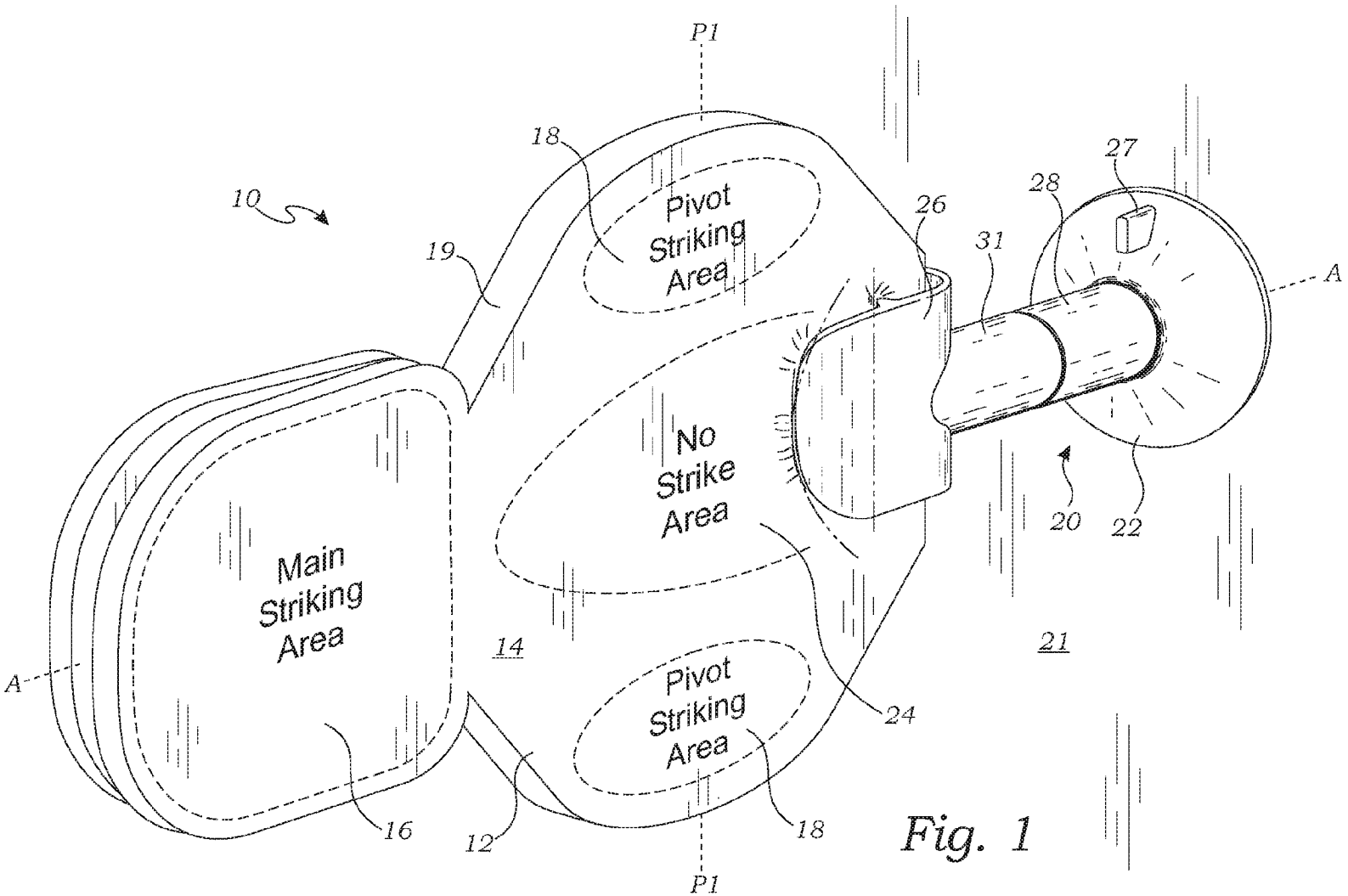
FIG. 1 is a perspective view of a first embodiment of the present invention, a striking target device having a striking surface, a base, and a pivot mechanism.

The preferred embodiment of the invention, shown in FIGS. 1-9, a striking target device 10 that includes a target body 12 with a striking surface 14 with a main striking area 16 and at least one pivot striking area 18; a base 20; and a pivot mechanism for pivotally mounting the target body 12 on the base 20 such that the striking surface 14 remains on a first plane P1 when struck in the main striking area 16, but pivots on an axis A to a different plane P2 when struck in the pivot striking area 18.

FIG. 1 is a perspective view of a first embodiment of the striking target device 10, illustrating one embodiment of the target body 12 and the striking surface 14. The target body 12 is preferably made of lightweight, high-density foam. In this embodiment, the target body 12 includes the main striking area 16 that is positioned opposite the base 20. The target body 12 is preferably split on the main striking area 16 through a no strike edge 19 to create a distinct audible feedback which is louder than the audible feedback produced by striking the pivot striking area 18. The louder audible feedback is a result of the two halves of the split main striking area 16 impacting each other when the main striking area 16 is struck.

In this embodiment, the striking surface 14 includes two pivot striking areas 18, one on either side of a no strike area 24 between the main striking area 16 and the base 20. When a pivot striking area 18 is struck, it applies a turning force to the target body 12 thereby pivoting it around the axis A and indexing the target body 12 to a new striking plane. A pivotal move is recognized as a result of the generally planner shape of the target body 12. The striking target device 10 could function with a variety of target body 12 shapes and sizes; provided there is enough striking surface area 14 for a main striking area 16 and a pivot striking area 18, and a sufficient difference in size or appearance of the striking surface 14 and the no strike edge 19 of the target body 12 creating a means for determining a pivotal move, thereby making it visually apparent to the user that target body 12 has pivoted to a new striking plane.

The base 20 functions to mount or otherwise position the striking target device 10 for use. The pivot mechanism for pivotally mounting the target body 12 on the base 20 functions to enable the pivoting action mentioned above and described in greater detail below. Two embodiments of the striking target device 10 are also described below. A first embodiment of the striking target device 10 is described in FIGS. 1-5, and a second embodiment is described in FIGS. 10-14. Those skilled in the art will recognize that the striking target device 10 could be constructed in many different ways to provide the functions described, and these alternative constructions should be expressly considered within the scope of the claimed invention.

Figure 2:
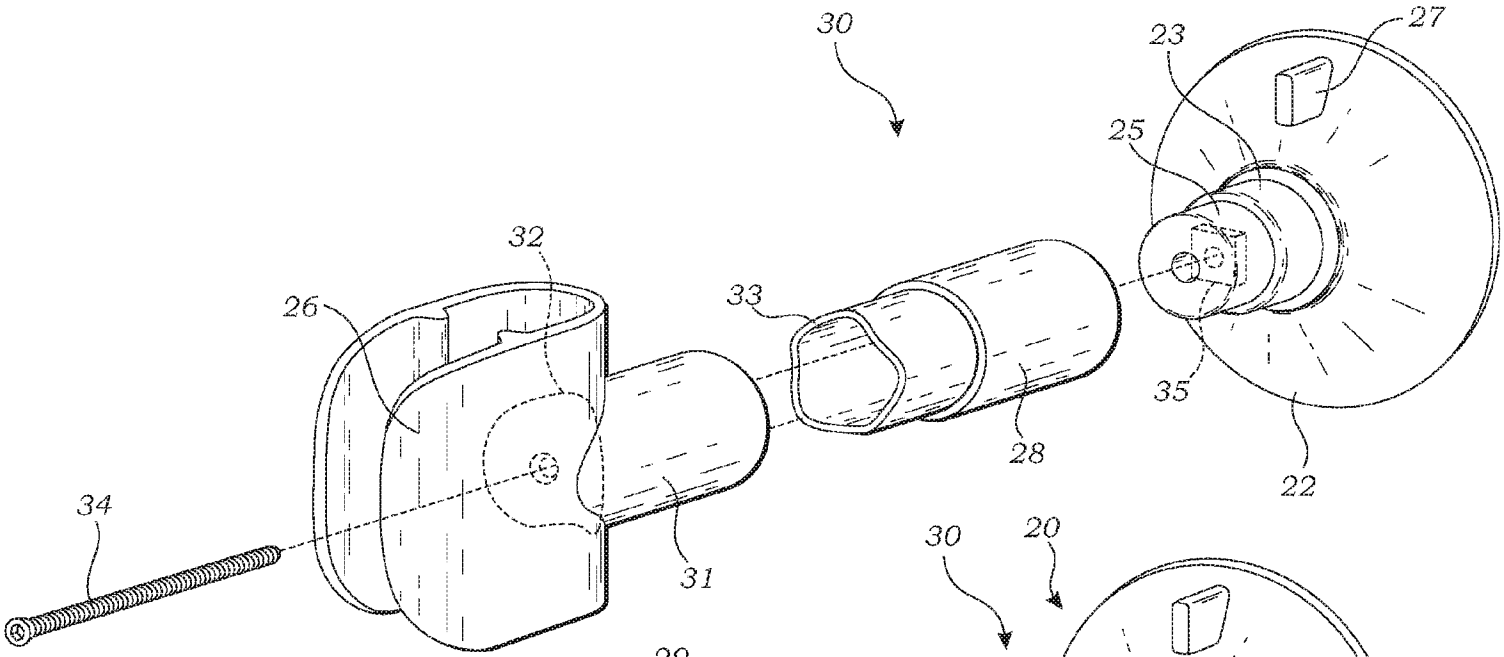
FIG. 2 is an exploded perspective view of the base and the pivot mechanism.

As shown in FIGS. 1-5, the base 20 may be a suction cup 22 adapted for attachment to a surface 21. In this embodiment, as shown in FIG. 2, the base 20 is a single molded piece and is comprised of the suction cup 22, a suction release tab 27, and a shank 23. The suction cup 22 can be mounted in any position on a smooth surface 21 and can be quickly and easily removed by pulling the suction release tab 27. The shank 23 has a diameter size that allows for a press fit attachment of a cam tube 28. The shank 23 has a smaller diameter portion, which provides the tension element 25 for the pivot mechanism 30.

In this embodiment, as shown in FIG. 2 the first embodiment of the pivot mechanism 30 includes a tension element 25, the cam tube 28, a cam edge 33, a guide tube 31, a cam follower 32, a target body holder 26, a screw 34 and a lock nut 35. The guide tube 31 inside diameter spins around the smaller outside diameter of the cam tube 28 to allow the target body 12 to rotate. The cam tube 28 has a cam edge 33. The guide tube 31, the cam follower 32 and the target body holder 26, described in greater detail below, are comprised of a single molded piece of rigid material of a different composition than that of the cam tube 28 and cam edge 33 to prevent wear and galling when their surfaces rub against each other.

Figure 3:
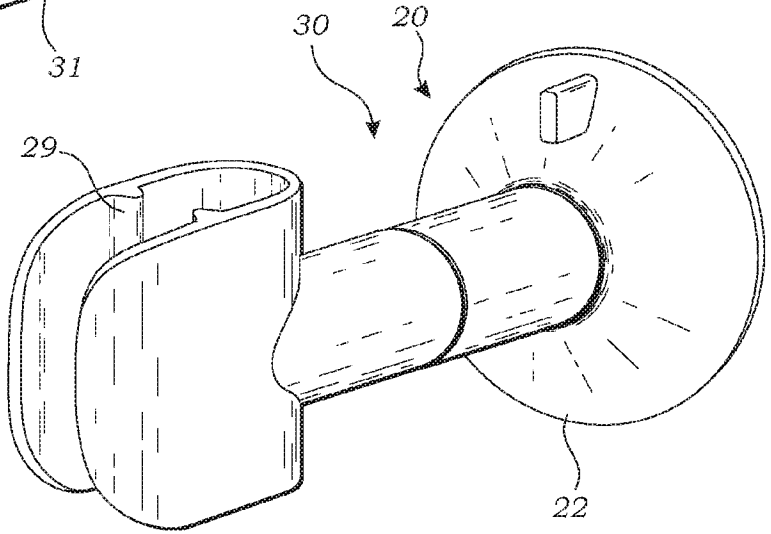
FIG. 3 is a perspective view thereof once the base and the pivot mechanism have been assembled.
Figure 4:
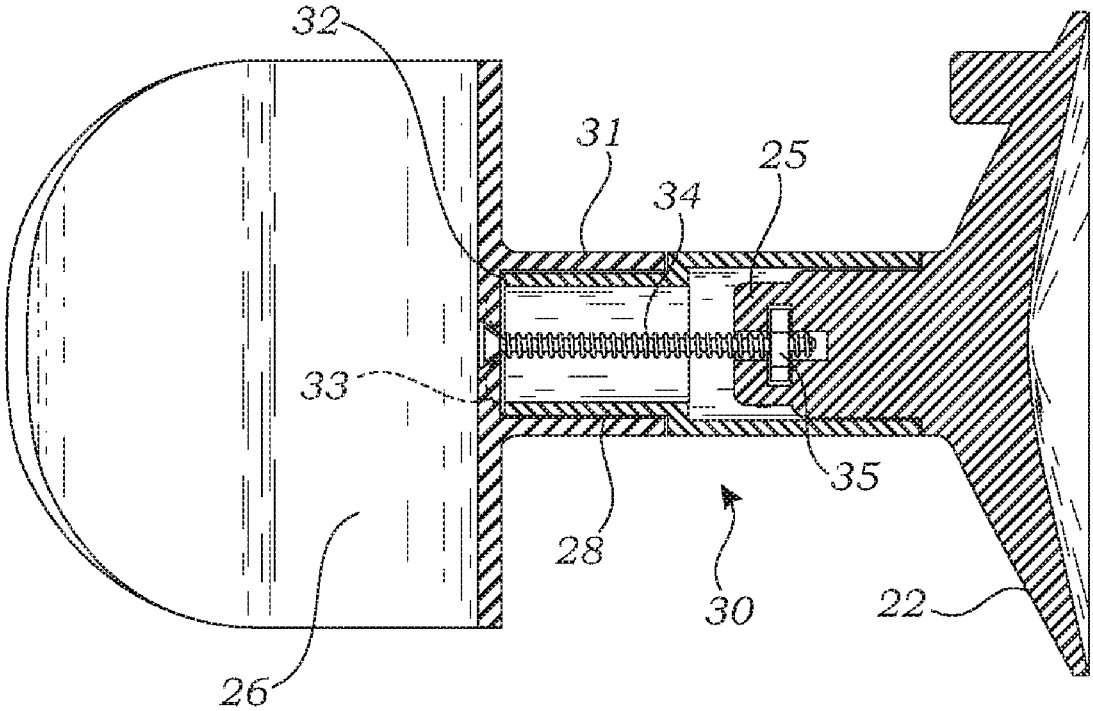
FIG. 4 is a cross-sectional view thereof.

As shown in FIGS. 2-4, the cam tube 28 is inserted into the guide tube 31 engaging the cam edge 33 with the cam follower 32. The cam follower 32 is an arched surface that bridges across the inside diameter of the guide tube 31. The cam follower 32 is held under tension on the cam edge 33 by force applied by tightening a fastening means comprising of the screw 34 and the lock nut 35. The lock nut 35 is molded into the tension element 25. The screw 34 is inserted into a countersunk hole in the backside of the cam follower 32. The threaded portion of the screw 34 pass through the guide tube 31 the cam tube 28, and a hole in the tension element 25 and is screwed into the lock nut 35 engaging the tension element 25. The underside of the screw 34 head is tapered allowing it to rest and pivot in the countersunk hole in the backside of the cam follower 32. The lock nut 35 and the hole in the tension element 25 that accept the screw 34, create sufficient drag on the threads of the screw 34 as to not allow the screw 34 to loosen or tighten when the turning force is applied to the screw 34 head as a result of a strike on the pivot striking area 18. The screw 34 is tightened into the lock nut 35 to apply tension thereby holding the cam follower 32 down on the low points of the cam edge 33. The amount of tension applied is regulated by tightening or loosening the screw 34.

As shown in FIGS. 1-2, When the pivot striking area 18 is struck, a turning force is applied to the cam follower 32. The turning force raises the cam follower 32 up and over the high points of the cam edge 33. The tension applied to the cam follower 32 by stretching the tension element 25, rapidly draws the cam follower 32 down on the next set of low points on the cam edge 33 which indexes the target body 12 to the next fixed striking plane. The degree of turn is dependent on the number of high and low points on the cam edge 33. The amount of striking force necessary to produce a striking plane change is regulated by the height of the high points of the cam edge 33 and the amount of tension applied by the tension element 25. The amount of tension applied by the tension element 25 is regulated by the size and flexibility of the material used for the tension element 25 and by tightening or loosening the screw 34 into the lock nut 35 which is molded into the tension element 25. The tension element 25 may be provided by a portion of the suction cup 22, as shown, which is naturally resilient. In alternative embodiments, one of which is described below, the tension element 25 could also be a spring or other element for providing a bias.

As shown in FIG. 2 and mentioned above, the target body holder 26, cam follower 32 and guide tube 31 are combined as a single molded piece of rigid material. The target body holder 26 has a slot with convex ridges 29 to help secure the target body 12 in the target body holder 26. The convex ridges 29 run parallel to the front opening of the target body holder 26 which allow the target body 12 to be slid in from the side, yet resist being pulled out when the target body 12 is struck. The target body 12 is secured in the target body holder 26 slot by means of a compression fit allowing it to be held in place when the target body 12 is struck.

Figure 5:
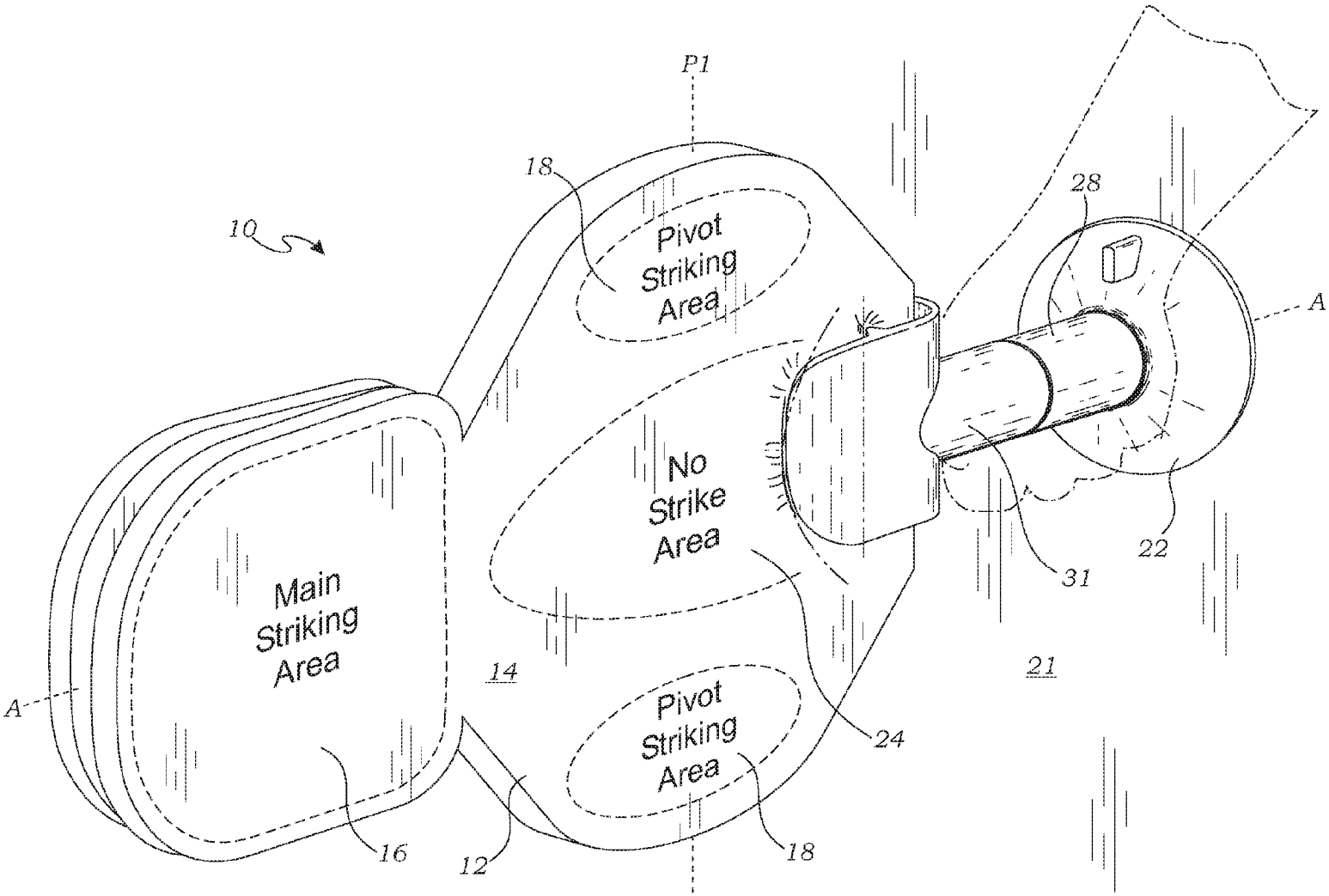
FIG. 5 is a perspective view of the striking target device being used as a hand-held target.

As shown in FIG. 5, the cam tube 28, guide tube 31 and the suction cup 22, together, provide an excellent grip for the hand-held use of the striking target device 10. The larger outside diameter of the cam tube 28 is the same diameter as the outside diameter of the guide tube 31, providing a consistent sized cylindrical handgrip area for hand holding the device. The handgrip area working in conjunction with the suction cup 22 creates a no-slip handgrip. The shape and size of the suction cup 22 prevent the device from being pulled out of the holder's hand when the target body 12 is struck hard. The flexible suction cup 22 provides a soft and comfortable stop when pulled against the hand as a result of a hard strike on the target body 12.

Figure 6:
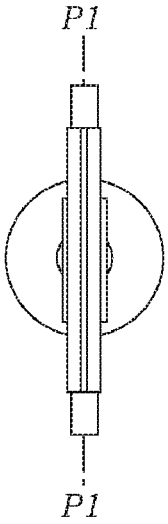
FIG. 6 is a side elevational view of the striking target device illustrating the striking surface disposed on a first plane.
Figure 7:
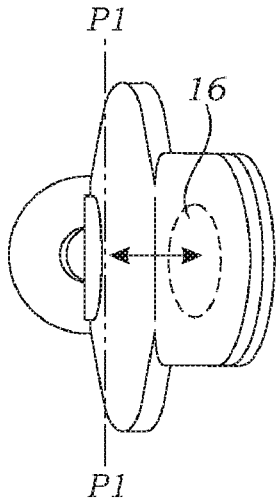
FIG. 7 is a side elevational view thereof once a main striking area has been struck.
Figure 8:
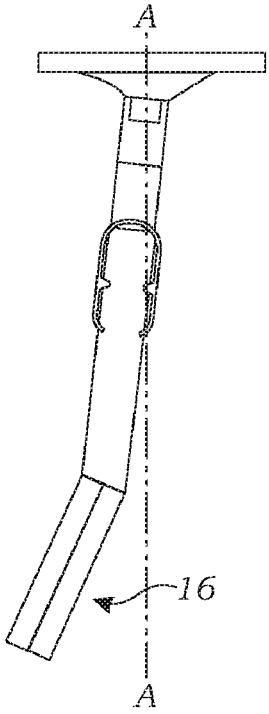
FIG. 8 is a top plan view thereof.
Figure 9:
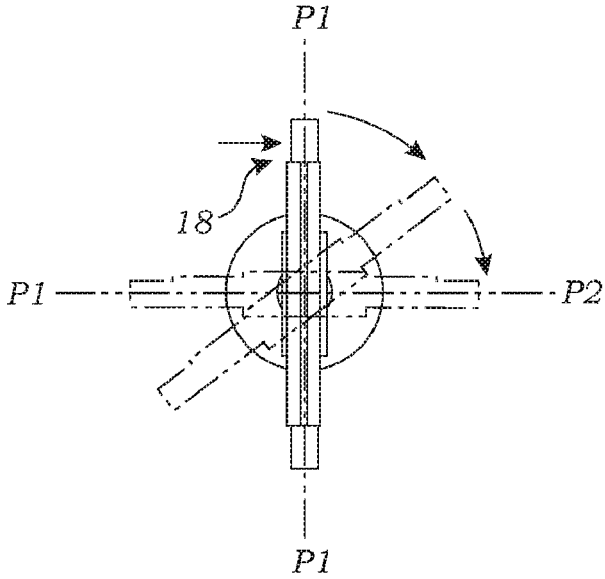
FIG. 9 is a side elevational view of the striking target device as it is being struck in a pivot striking area, illustrating how the target body moves from the first plane to a second plane.

FIGS. 6-9 demonstrate the use of the striking target device 10, and illustrate the flexing and pivoting action of the target body 12. FIG. 6 is a side elevational view of the striking target device 10 illustrating the target body 12 in a resting position on a first plane P1. Once the striking target device 10 has been struck in the main striking area 16, as shown in FIG. 7, the target body 12 flexes and then returns to the resting position on plane P1. The flexing is illustrated further in FIG. 8, a top plan view of the striking target device 10 that shows the striking target device 10 flexing across the axis A as a result of a strike to the main striking area 16. This flexing is achieved as a result of the pliable nature of both the base 20 and the target body 12. The flexing or bending across the axis A absorbs the force when the target body 12 is struck in the main striking area 16, allowing for full follow through of the strike. FIG. 9 illustrates the movement of the striking target device 10 when the target body 12 has been struck in one of the pivot striking areas 18. As illustrated in FIG. 9, an impact on the pivot striking area 18 causes the target body 12 to rotate from the first plane P1 to a second plane P2. In this embodiment, the cam edge 33 is adapted so that the second plane P2 is 90 degrees from the first plane P1; however, the degree of rotation is dependent on the number of high and low points on the cam edge 33. The cam edge 33 could also be flat with no high or low points to provide an infinite amount of rotation positions. However, those skilled in the art could adapt various mechanisms to provide different degrees of fixed position rotation, or even an infinitely variable amount of rotation positions.

ALTERNATIVE EMBODIMENT

In an alternative embodiment of the invention, shown in FIGS. 10-14, a striking target device 70 includes a target body 72 with a striking surface 74 with a main striking area 76 and at least one pivot striking area 78; a base 50; and a pivot mechanism 30 for pivotally mounting the target body 72 on the base 50 such that the striking surface 74 remains on a first plane P1 when struck in the main striking area 76, but pivots on an axis A to a different plane when struck in the pivot striking area 78.

Figure 10:
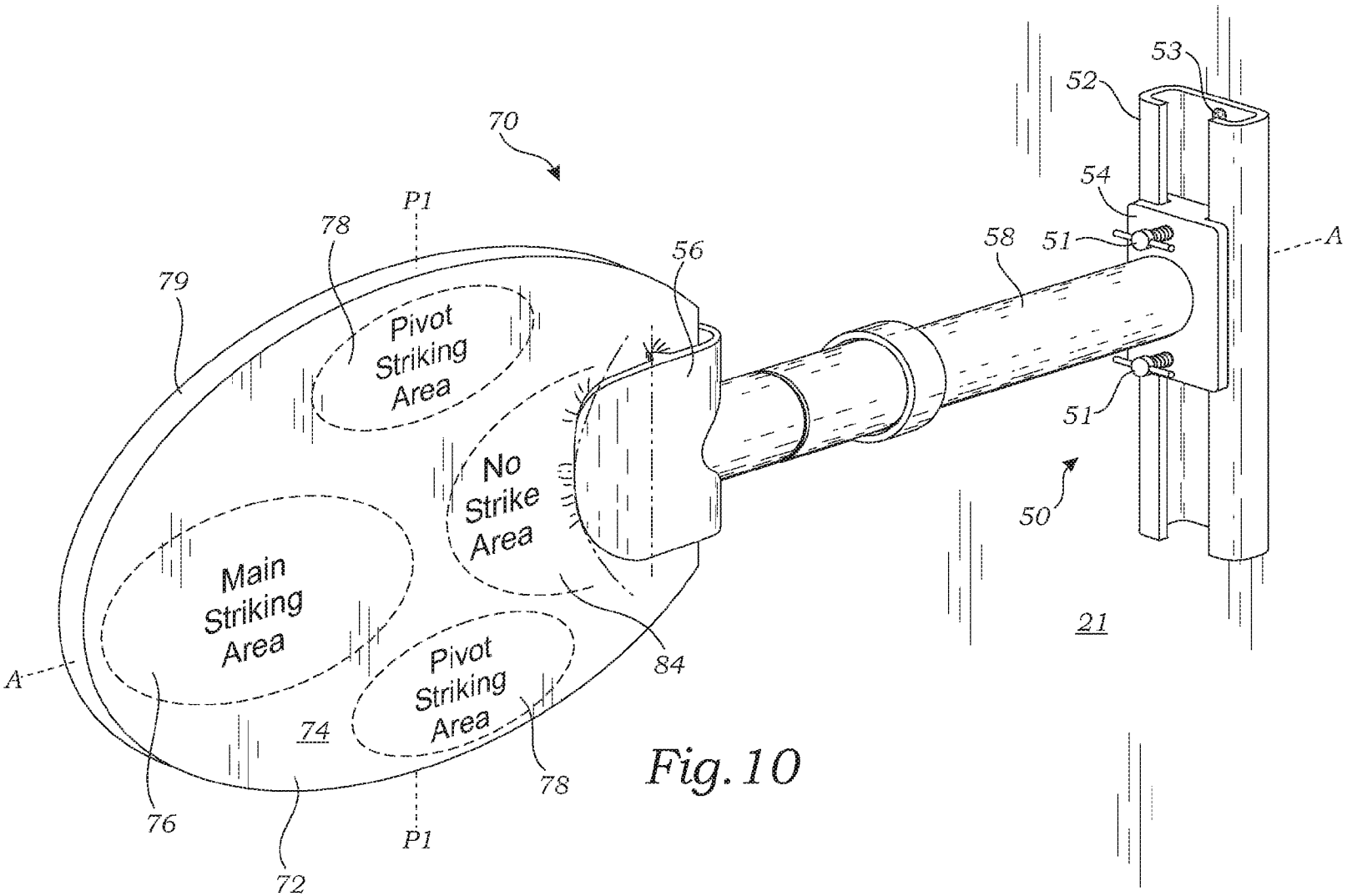
FIG. 10 is a perspective view of a second embodiment of the striking target device.

FIG. 10 is a perspective view of the alternative embodiment of the striking target device 70, illustrating one embodiment of the target body 72 and the striking surface 74. The target body 72 is preferably made of lightweight, high-density foam. In this embodiment, the target body 72 includes the main striking area 76 that is positioned opposite the base 50.

In this embodiment, the striking surface 74 includes two pivot striking areas 78, one on either side of a no strike area 84 between the main striking area 76 and the base 50. When a pivot striking area 78 is struck, it applies a turning force to the target body 72 thereby pivoting it around the axis A and indexing the target body 72 to a new striking plane. A pivotal move is recognized as a result of the generally planner shape of the target body 72. The striking target device 70 could function with a variety of target body 72 shapes and sizes; provided there is enough striking surface area 74 for a main striking area 76 and a pivot striking area 78, and a sufficient difference in size or appearance of the striking surface 74 and a no strike edge 79 of the target body 12 creating a means for determining a pivotal move, thereby making it visually apparent to the user that target body 72 has pivoted to a new striking plane.

Figure 11:
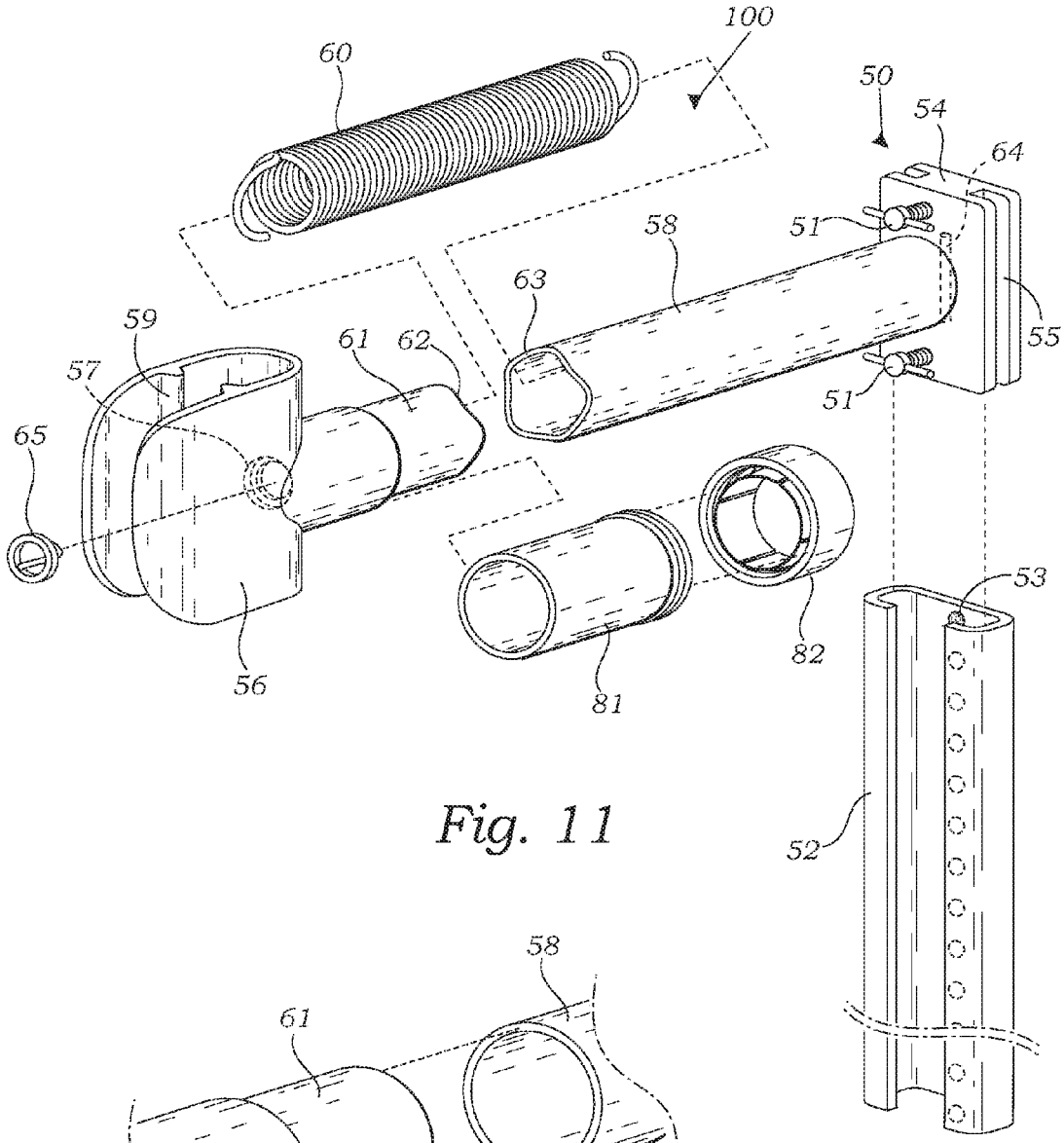
FIG. 11 is an exploded perspective view thereof.
Figure 14:
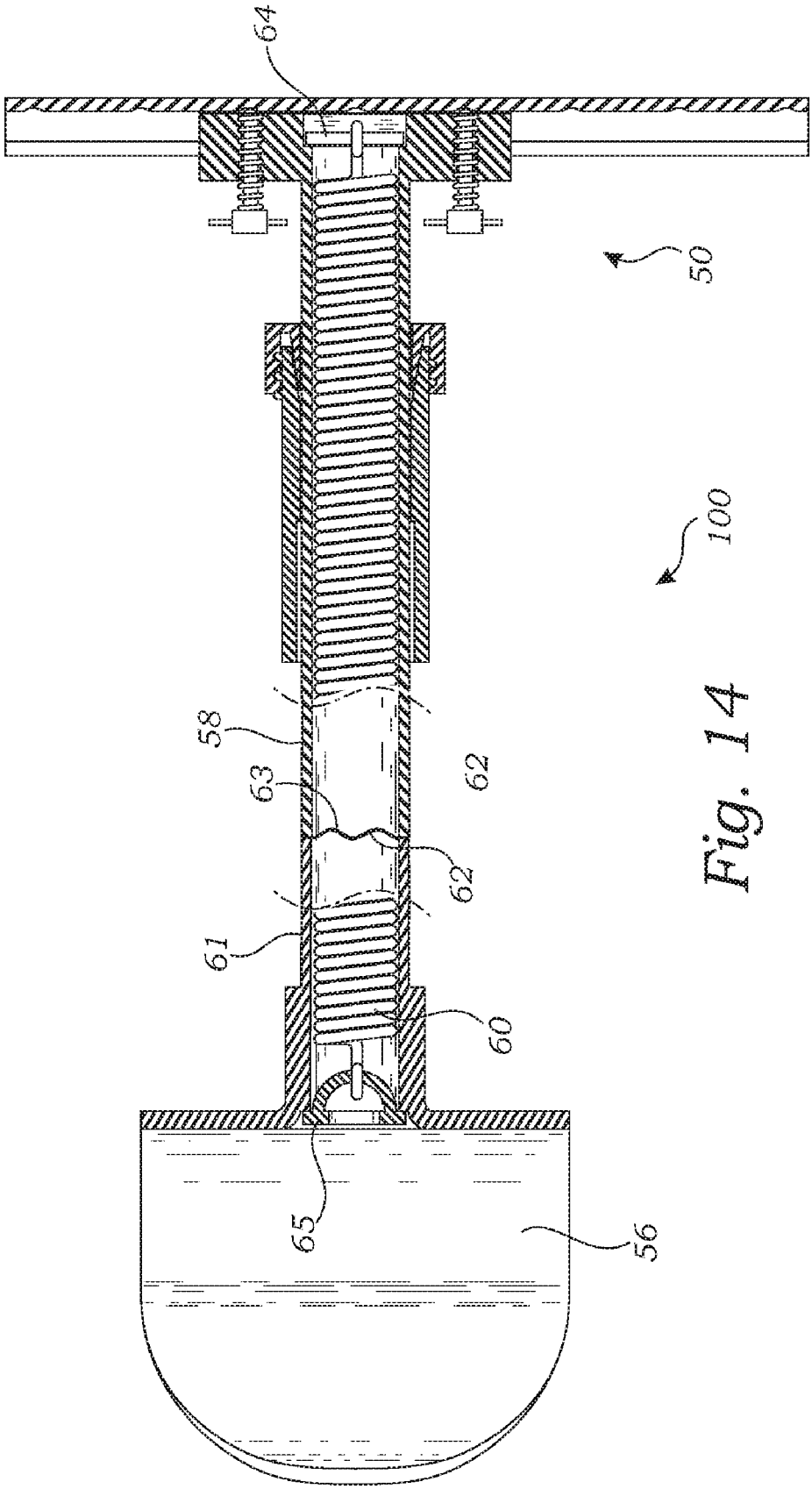
FIG. 14 is a cross-sectional view thereof with the flex lock unit disengaged.

As shown in FIG. 11, the base 50 includes a mounting rack 52, a mounting plate 54 and position lock screws 51. The base 50 functions to mount or otherwise position the striking target device 70 for use. The pivot mechanism 30 for mounting the target body 72 on the base 50 functions to enable the pivoting action mentioned above and described in greater detail below. The mounting rack 52 can be mounted in any position on any surface 21 or on a moveable stand with a fastening means. The mounting rack 52 is a rigid channel that the mounting plate 54 slides up and down on as a means of height adjustment. The mounting plate 54 has grooves 55 that allow it to be slid on the mounting rack 52. The mounting plate 54 can be secured in position by tightening the position lock screws 51 into the indentations 53 on the inside back surface of the mounting rack 52. The mounting plate 54 can be easily repositioned or removed by loosening the position lock screws 51. As shown in FIG. 14 the mounting plate 54 has a through-hole to allow the tension element 60 to pass through and be secured by an anchor pin 64. The backside of the hole in the mounting plate 54 has a slot that secures the anchor pin 64 and prevents it from pivoting. A cam tube 58 is affixed to the mounting plate 54. The outside diameter of the cam tube 58 creates a means for handholding the device.

In this embodiment, as shown in FIG. 11 the pivot mechanism 100 includes the anchor pin 64, the tension element 60, the cam tube 58, a cam edge 63, a cam follower 62, a guide tube 61, a target body holder 56 and an anchor pivot ring 65. The inside diameter of the guide tube 61 spins around the outside diameter of the tension element 60 to allow the target body 72 to rotate. The inside and outside diameter of the cam tube 58 and guide tube 61 are identical. The cam tube 58 has a cam edge 63. The guide tube 61, a cam follower 62 and a target body holder 56, described in greater detail below, are comprised of a single molded piece of rigid material of a different composition than that of the cam edge 63 to prevent wear and galling when their surfaces rub against each other. The cam follower 62 is located on the rearmost edge/circumference of the guide tube 61.

As shown in FIGS. 11 and 14, the tension element 60 is inserted into the guide tube 61 and attached to an anchor pivot ring 65 which pivots on a counterbored hole 57 in the target body holder 56 thereby allowing the target body 72 to pivot when struck in the pivot striking area 78. The opposite end of the tension element 60 is inserted into the cam tube 58 and is secured to the rear side of the mounting plate 54 with the anchor pin 64 thereby engaging the cam edge 63 under tension with the cam follower 62.

The cam follower 62 and the cam edge 63 have equal but opposing high and low points. The cam follower 62 is held under tension on the cam edge 63 by force applied through expansion of the tension element 60. The tension element 60 is an extension spring that is a slip fit inside the guide tube 61 and the cam tube 58. This close slip fit allows the guide tube 61 to rotate around the outside diameter of the tension element 60 while maintaining alignment between the guide tube 61 and the cam tube 58. The tension element 60 is expanded creating a compression to hold the cam follower 62 and the cam edge 63 together creating resistance to the turning force that is applied when the target body 72 is struck in the pivot striking area 78. When this turning force is great enough, the target body 72 pivots to the next fixed striking plane. The free spinning anchor pivot ring 65 allows this turning force to go indefinitely in either direction without creating a winding torque. The turning force raises the cam follower 62 up and over the high points of the cam edge 63. The tension applied to the cam follower 62 by stretching the tension element 60, rapidly draws the cam follower 62 down on the next low points of the cam edge 63 which indexes the target body 72 to the next fixed striking plane or position. The degree of turn is dependent on the number of high and low points on the cam edge 63 and the cam follower 62. The amount of striking force necessary to produce a striking plane change is regulated by the strength of the tension element 60, working in conjunction with the differential between the high and low points on the cam edge 63 and the cam follower 62.

Figure 11B:
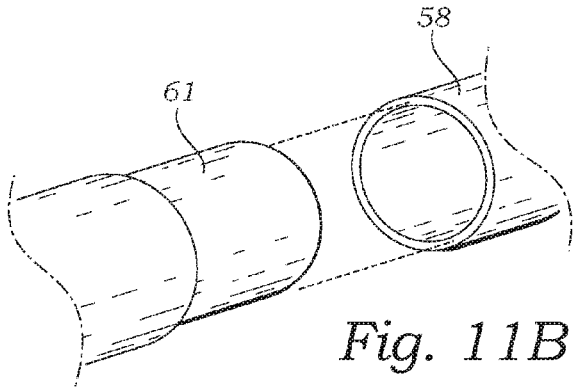
FIG. 11*b* is an exploded perspective view of an infinite position pivot.

Alternatively, as shown in FIG. 11*b*, the guide tube 61 has a flat edge with no cam follower 62 and the cam tube 58 has a flat edge with no cam edge 63. When the target body 72 is struck in the pivot striking area 78, the smooth edges allow the target body 72 to spin and rest in an infinite number of striking planes creating a random position target body 72 that the user would have to strike from all striking angles. The target body 72 resting position after a strike in the pivot striking area 78 is a result of where the target body 78 is struck and how hard it is struck.

As shown in FIG. 11 and mentioned above, the target body holder 56, cam follower 62 and guide tube 61 are combined as a single molded piece of rigid material. The target body holder 56 has a slot with convex ridges 59 to help secure the target body 72 in the target body holder 56. The convex ridges 59 run parallel to the front opening of the target body holder 56 which allow the target body 72 to be slid in from the side, yet resist being pulled out when the target body 72 is struck. The target body 72 is secured in the target body holder 56 slot by means of a compression fit allowing it to be held in place when the target body 72 is struck.

As shown in FIG. 14 the tension element 60 requires lateral integrity to hold the guide tube 61 and the cam tube 58 in proper alignment. For example, the outside diameter of the tension element 60 should be sized to allow it to slip inside the inside diameter of the guide tube 61 and the cam tube 58 without excessive drag or clearance to establish a close slip fit. The close slip fit keeps the target body 72 from deflecting as a result of the weight of the striking target device 70 and keeps the cam edge 63 and the cam follower 62 in alignment.

Once the striking target device 70 has been struck in the main striking area 76, the target body 72 flexes and bounces and then returns to the resting position. This flexing is achieved as a result of the pliable nature of the target body 72 and the lateral flexing and bouncing capability of the tension element at the intersection of the cam follower 62 and the cam edge 63. The flexing or bending across the axis absorbs the force when the target body 72 is struck in the main striking area 76, allowing for full follow through of the strike.

Figure 12:
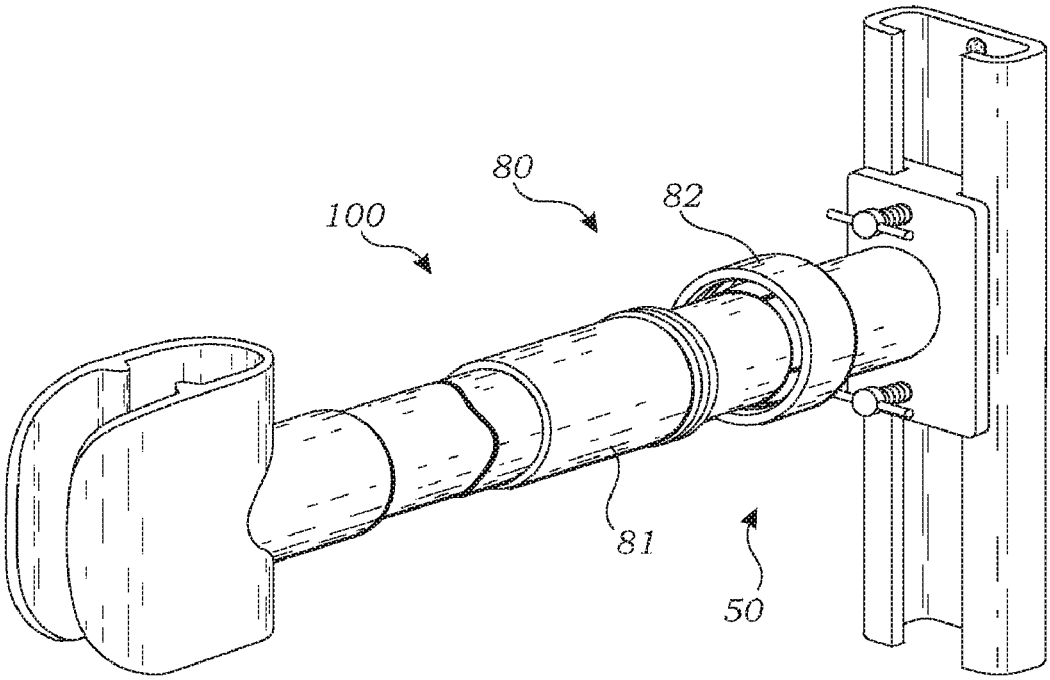
FIG. 12 is a perspective view thereof once the base and the pivot mechanism have been assembled.
Figure 13:
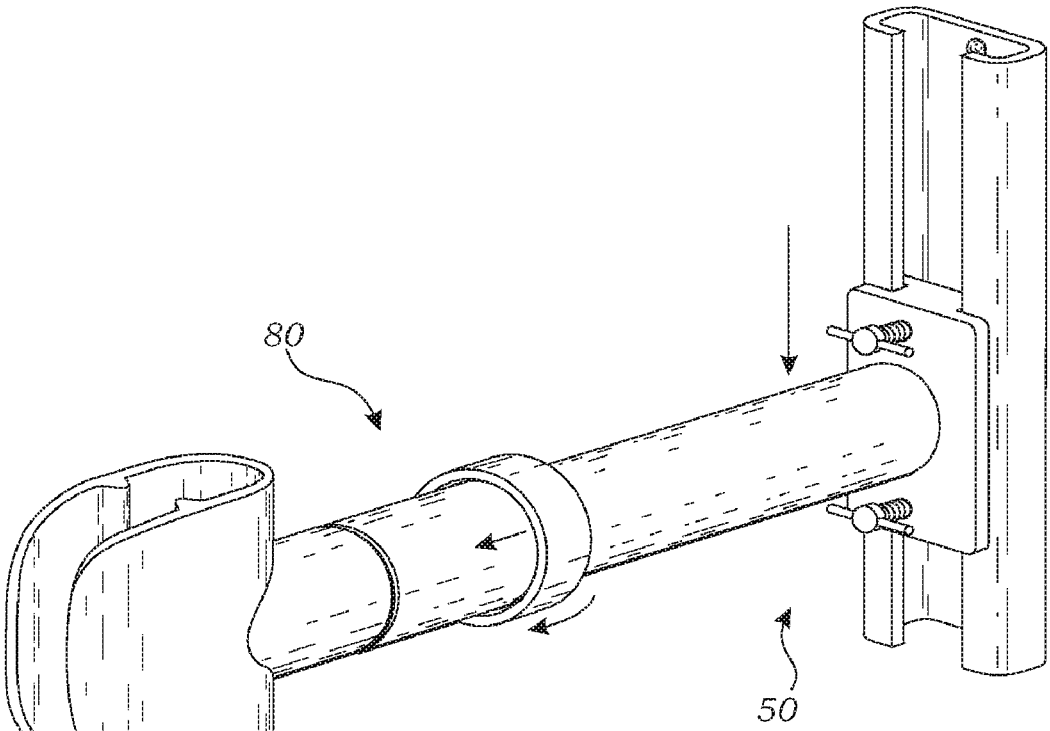
FIG. 13 is a perspective view illustrating a flex lock unit engaged over the pivot.

As shown in FIGS. 12 and 13, the flex lock unit 80 is comprised of a locking tube 81 and a locking collar 82. The flex lock unit 80 can be engaged by sliding it over the intersection of the cam edge 63 and the cam follower 62 and then tightening the locking collar 82 onto the locking tube 81 thereby affixing the flex lock unit 80 in position preventing flex and bounce movement across the axis A. A flex lock unit 80 could be provided with a smaller inside diameter creating a press fit on the guide tube 61 that would disable the flex, bounce and pivot features of the pivot mechanism 100. This enables the striking target device 70 to function like a traditional focus target.

DESCRIPTION OF HOW THE DEVICE WORKS

The user performs the following actions: (i) The user secures the device 10 at the desired height on a surface 22 such as a wall, mirror, or stand, using the base 20. In an alternative embodiment, the user simply has a partner hold it by the base 20, as described above. (ii) The user faces the front of the device 10, the end with the target body, or stands to the side of the device, depending on which type of strike the user is going to execute. (iii) The user starts striking the target body 10 in the main striking area 16 as they would a normal focus target. (iv) The user is then able to strike the pivot striking area 18 to initiate a turn or pivot, creating a new striking plane to allow for different strikes (vertical, horizontal or in-between). (v) The user can do simple strikes, combinations of strikes or long strike routines to achieve a cardiovascular workout and general health and fitness benefits. This allows for speed, timing, coordination and accuracy training as well as a way to improve overall skill level of performing all types of strikes. The device can also be used with instructional assistance such as an instructional video explaining basic use, a routine video/s, DVD/s showing how to do routines, and/or routine cards or booklets with printed routines and a timer to time the strike routines.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A striking target device comprising:

a target body with a generally planar striking surface with a main striking area and at least one pivot striking area;

a base; and a pivot mechanism for pivotally mounting the target body on the base such that the striking area is biased to return to a first plane when struck in the main striking area, but pivots on an axis to a different fixed plane when struck in the pivot striking area, wherein the pivot mechanism includes a cam edge of the base, a cam follower of a guide tube of the target body, and a tension element for biasing the cam edge against the cam follower, allowing the target body to pivot about the axis such that striking surface pivots to a different fixed striking plane when struck in the pivot striking area.

2. The striking target device of claim 1, wherein the main striking area is located substantially on the axis, and the pivot striking area extends outwardly from the axis.

3. The striking target device of claim 1, wherein the tension element is a spring.

4. A method for strike training, the method comprising the steps of:

providing a striking target device comprising:

a target body with a generally planar striking surface with a main striking area and at least one pivot striking area;

a base; and a pivot mechanism for pivotally mounting the target body on the base such that the striking area is biased to return to a first plane when struck in the main striking area, but pivots on an axis to a different plane when struck in the pivot striking area, wherein the pivot mechanism includes a cam edge of the base, a cam follower of a guide tube of the target body, and a tension element for biasing the cam edge against the cam follower, allowing the target body to pivot about the axis such that striking surface pivots to a different fixed striking plane when struck in the pivot striking area;

positioning the striking target device at a desired height;

striking the striking target device in the striking area such that the target body moves away from the first plane in response to the strike and then returns to the first plane under the bias of the pivot mechanism; and striking the striking target device in the pivot striking area, thereby indexing the target body from the first plane to the second plane.

* * * * *